US006712225B2

(12) United States Patent
McNeely

(10) Patent No.: US 6,712,225 B2
(45) Date of Patent: Mar. 30, 2004

(54) SOCKET HOLDER WITH WEDGE RETENTION AND ROTATIONAL RELEASE

(75) Inventor: John T. McNeely, Rockvale, TN (US)

(73) Assignee: Skideely Inc., Reno, NV (US)

( * ) Notice: Subject to any disclaimer, the term of this patent is extended or adjusted under 35 U.S.C. 154(b) by 0 days.

(21) Appl. No.: 10/076,924

(22) Filed: Feb. 14, 2002

(65) Prior Publication Data

US 2003/0150824 A1 Aug. 14, 2003

(51) Int. Cl.[7] ..... A47F 7/00
(52) U.S. Cl. ..... 211/70.6; 206/378
(58) Field of Search ..... 211/70.6; 206/378, 206/377, 376, 373, 375, 372, 493, 806; 403/343, 374.1, 342

(56) References Cited

U.S. PATENT DOCUMENTS

| | | | | | |
|---|---|---|---|---|---|
| 1,712,473 | A | | 5/1929 | McWethy | |
| 3,622,169 | A | * | 11/1971 | Koch et al. | 279/76 |
| 4,245,528 | A | * | 1/1981 | Hugh et al. | 224/255 |
| 4,502,824 | A | * | 3/1985 | Dohse et al. | 81/177.85 |
| 4,865,485 | A | * | 9/1989 | Finnefrock, Sr. | 408/139 |
| 5,199,833 | A | * | 4/1993 | Fehrle et al. | 408/239 R |
| 5,228,570 | A | | 7/1993 | Robinson | 206/378 |
| 5,341,708 | A | * | 8/1994 | Nick | 16/113.1 |
| 5,467,874 | A | | 11/1995 | Whitaker | 206/378 |
| 5,501,342 | A | | 3/1996 | Geibel | 206/378 |
| 5,531,140 | A | * | 7/1996 | Chow | 285/345 |
| 5,674,024 | A | * | 10/1997 | Daumal Castellon | 279/103 |
| 5,820,291 | A | * | 10/1998 | Lutz | 279/76 |
| 6,003,414 | A | * | 12/1999 | Hsieh | 81/177.85 |
| 6,006,631 | A | * | 12/1999 | Miner et al. | 408/239 R |
| 6,032,797 | A | | 3/2000 | Kao | 206/378 |
| 6,070,745 | A | | 6/2000 | Dembicks | 211/70.6 |
| 6,092,655 | A | | 7/2000 | Ernst | 206/378 |
| 6,164,169 | A | * | 12/2000 | Goff | 409/234 |
| 6,168,018 | B1 | | 1/2001 | Ramsey et al. | 206/378 |
| 6,386,789 | B1 | * | 5/2002 | Chausse et al. | 82/1.2 |

* cited by examiner

*Primary Examiner*—Daniel P. Stodola
*Assistant Examiner*—Khoa Tran
(74) *Attorney, Agent, or Firm*—Waddey & Patterson; Emily A. Shouse; David B. Pieper

(57) ABSTRACT

A socket holder for providing increased holding power, rotational release, and biased position return. The socket holder including a base with a pin extending from the base. The pin has a conical section with an increasing diameter at the distal end of the pin. The conical section has a reduced curvature side and an increased curvature side such that a ball can be wedged between the increased curvature side and a socket base to hold the socket on the holder. The reduced curvature side allowing the ball to be rotated around the pin to reduce the wedge force between the ball and the socket to release the socket from the holder. A spring is used to both bias the ball against the pin and the socket base and to automatically return the holder to a state of readiness for holding a new socket once a socket is removed from the holder.

5 Claims, 8 Drawing Sheets

SOCKET HOLDER WITH WEDGE RETENTION AND ROTATIONAL RELEASE

BACKGROUND OF THE INVENTION

The present invention relates generally to convenient tool storage and more particularly, this invention pertains to a socket holder with a quick release feature.

Several United States Patents are directed to various storage assistance devices for sockets. These include: U.S. Pat. No. 1,712,473, issued to McWethy on Aug. 18, 1927; U.S. Pat. No. 5,228,570, issued to Robinson on May 11, 1992; U.S. Pat. No. 5,467,874, issued to Whitaker on Jan. 10, 1995; U.S. Pat. No. 5,501,342, issued to Geibel on Jun. 26, 1995; U.S. Pat. No. 6,032,797, issued to Kao on Feb. 26, 1999; U.S. Pat. No. 6,070,745, issued to Dembicks on Jan. 21, 1998; U.S. Pat. No. 6,092,655, issued to Ernst on May 10, 1999; and U.S. Pat. No. 6,168,018, issued to Ramsey et al. on Sep. 20, 1999. Each of these patents is hereby incorporated by reference.

U.S. Pat. No. 1,712,473 teaches a holder for a set of sockets comprising a bar to which a plurality of posts are attached. Each post has a transverse opening in which two balls and a spring are mounted such that the balls slightly protrude from each side of the opening. When a socket is forced over the post, the balls are forced inward slightly so that the expansion of the spring grips the socket firmly. The '473 Patent does not address the problem of easily removing a socket from a post without exerting force.

U.S. Pat. No. 5,228,570 teaches an improved wrench socket storage rack which not only enables the organization of socket sets by dimensional graduations, but also includes means providing instantaneous socket release from the wrench socket storage rack with the touch of a fingertip on a release button. A ball locks into an indentation on the inside of a socket. The release button is on the underneath of the rack. When it is pushed, the ball retracts into a cavity in the pin and allows the socket to slide off the post. This requires that the underside of the rack be available to access the button.

U.S. Pat. No. 5,467,874 teaches an improved socket holder which provides a positive means of attachment and retention of all socket tools while allowing of a simple mechanical maneuver to readily release the socket from the holder. This device includes a ball and recess in the post. When rotated a quarter-turn, the ball retreats into the recess and allows a socket to slide on and off easily. The holding force is limited by the strength of the spring pressing against the ball.

U.S. Pat. No. 6,070,745 teaches a holder system for interchangeable sockets which prevents the sockets from being removed from a rack when the holder system is being used to display the sockets for sale. The system comprises a lock which is inserted in the cavity of the socket to hold it in place.

U.S. Pat. No. 6,092,655 teaches a wrench socket holder having a boss on a resilient member which holds sockets on a socket holder. The '655 Patent does not teach a means of removing a socket other than by force.

The remaining patents show alternative designs known in the art.

What is needed, then, is a socket holder to provide improved strength holding power while providing an easy release action for the socket to holder connection.

SUMMARY OF THE INVENTION

The novelty of the invention is an improved apparatus and method to store sockets. The base of the invention comprises a head including an outer shell with an internal ball for holding the socket. When a socket is placed on the head, the ball maintains a snug grip on the socket by pressing against the sidewall or pressing into the indentation in the socket. To remove the socket, the head is rotated a quarter-turn, causing the ball to recess into the head and allowing the socket to slide easily off the head. This allows a user to remove a socket using only one hand.

A major improvement of this invention is the increased holding power for maintaining a socket in position on the head when the head is inserted into the socket base. The head forms an outer shell with a vertical opening in which a ball is partially recessed and held in place against an internal pin by a spring. The internal pin has a cone shaped body. The ball is held in position between coils of the spring such that it is biased in an extended position in relation to the head. The cone shaped internal pin and the internal wall of the socket base form a wedge such that once the head is inserted into the socket base, the application of a removal force to the socket wedges the ball between the internal wall of the socket base and the internal pin of the socket holder increases the holding power as the removal force is increased.

To overcome the improved holding force of the present invention, a flat or reduced curvature face is formed on the internal pin of the head to allow for the ball to recess within the head for removal of the socket. The ball is rotatably positioned between an increased diameter section and a reduced diameter section of the pin by rotation of the outer shell in relation to the internal pin. The rotation of the outer shell is improved in the present invention by biasing the relationship of the outer shell and the internal pin into a holding position such that it automatically returns to the holding position once the rotational force is removed.

The holding position is also improved by allowing insertion of a socket onto the head while the head is in the holding position. This only requires a pressing force of the socket onto the head. The conical section of the internal pin allows the ball to be pressed down against the spring and recessed into the outer shell until the socket has sufficient clearance to be mounted on the head. This allows the easy connection of the socket onto the head by a pressing force against the head and allows for variations in the clearances of the socket recesses while still maintaining improved holding power for the socket holder.

DESCRIPTION OF THE PREFERRED EMBODIMENTS

Figure 1:
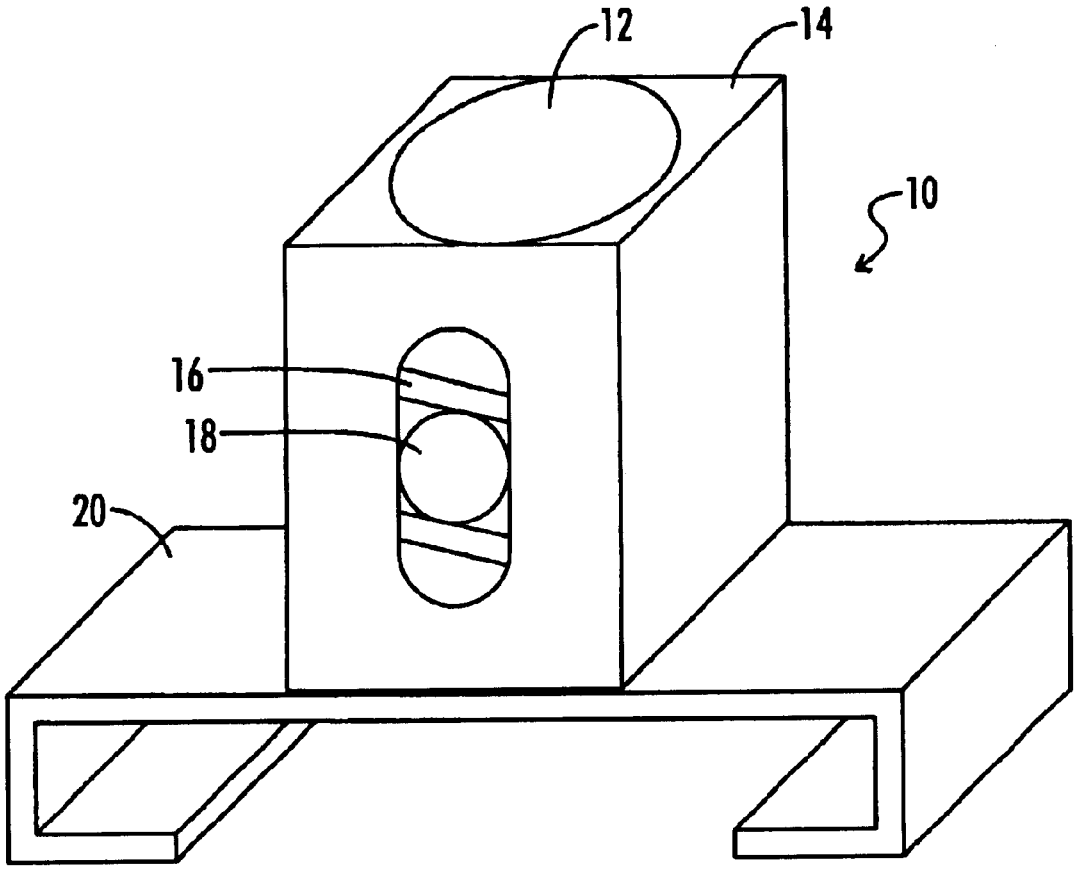
FIG. 1 is an isometric view of the socket holder.
Figure 2:
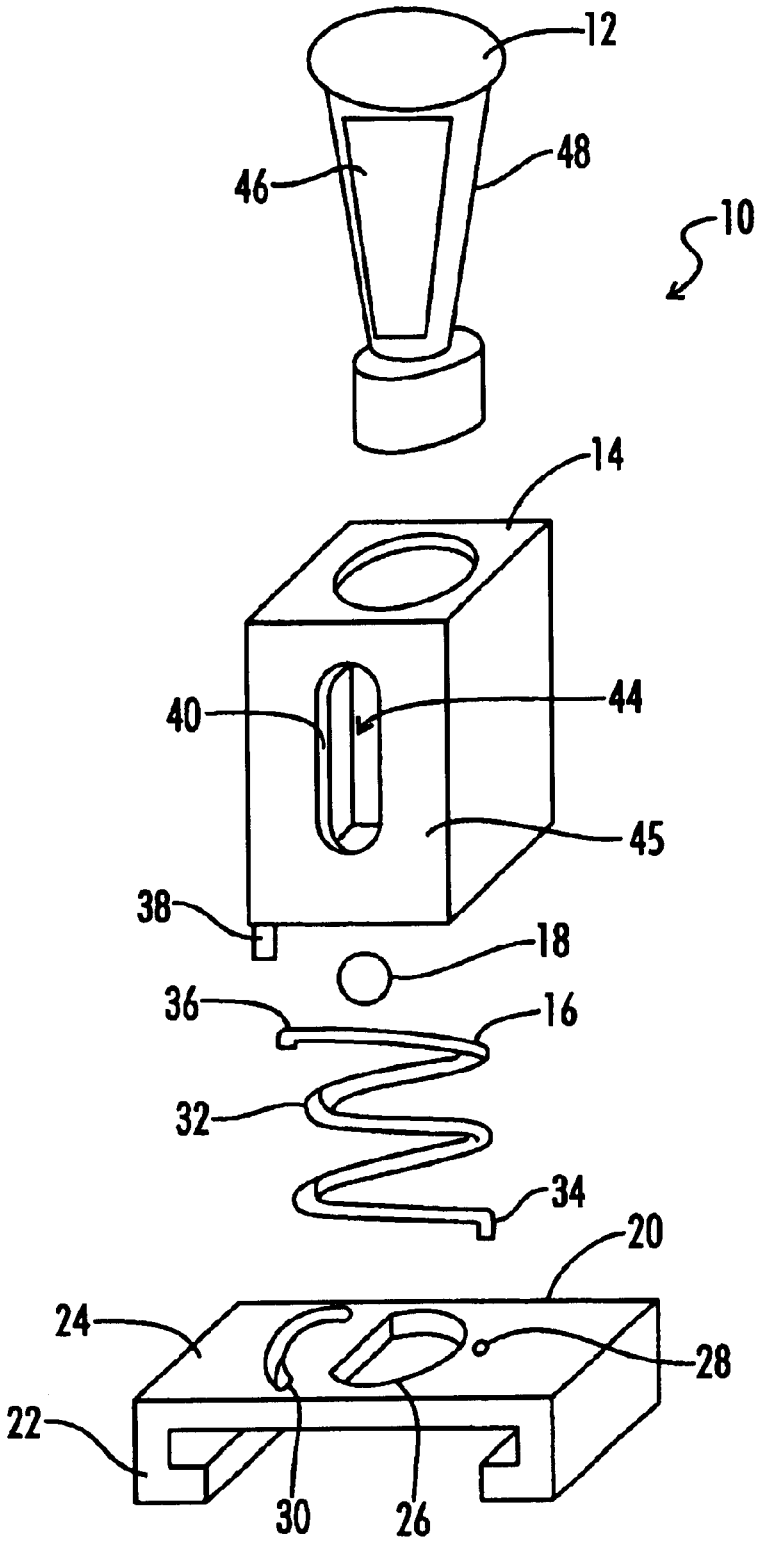
FIG. 2 is an exploded view of the components of the socket holder.

FIG. 1 of the drawing shows an assembled socket head 10 and FIG. 2 of the drawings shows and exploded view of the socket head 10. The socket head 10 includes an outer shell 14 mounted by an internal pin 12 on a base 20. The preferred embodiment of the invention shown in the drawings uses a rail base 20 for slideable engagement with a standard socket rail as is well known in the prior art. However, the base 20 may be of any type appropriate for the application.

The base 20 is shown as a rail base 20 with rail ears 22 and a base platform 24 defining a base pin hole 26, base spring hole 28, and movement control slot 30. The rail ears 22 are designed to engage a socket rail as is known in the art. A spring 16 is mounted on the rail base 20 by insertion into the base spring hole 28. The spring 16 is a coil spring with coils 32 and a lower end 34 and an upper end 36. The lower end 34 of the spring 16 is inserted into the base spring hole 28. The ball 18 is placed between two coils 32 of the spring 16. An outer shell 14 is then inserted over the spring 16 and ball 18 assembly.

The internal pin 12 is then inserted into the pin hollow 44 in the outer shell 14 and extended through the pin opening in the rail base 20. The pin is then fixed in position to the rail base 20 such that rotation of the outer shell 14 in relation to the rail base 20 also rotates the relative position of the outer shell 14 in relation to the internal pin 12. In the preferred embodiment, the socket holder is constructed of steel and the pin is welded to the rail base 20 although any type of connection known in the art may be provided. The orientation of the flat portion 46 of the pin in relation to base 20 is important to achieve the advantages of the present invention and will be discussed further herein.

The outer shell 14 defines a limiting finger 38 on the external portion of the shell 14 and an internal central pin hollow 44 with a shell spring hole 42 and a ball opening 40 that are both connected with the central pin hollow 44. The ball opening 40 extends from the pin hollow 44 through the outer wall 45 of the outer shell 14 such that a portion of the ball 18 can extend outward from the outer shell 14. This also allows the position of the ball opening 40 to control the position of the ball 18 in the pin hollow 44. The ball opening 40 is sized such that the ball 18 cannot pass through the ball opening 40.

Figure 8:
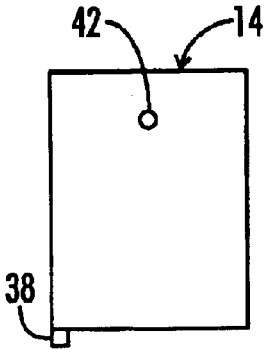
FIG. 8 is a left side view of the outer shell.
Figure 9:
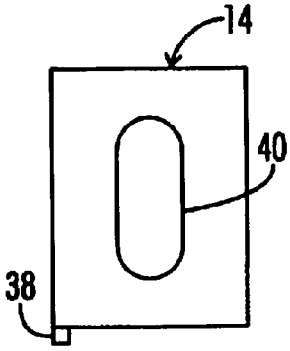
FIG. 9 is a front view of the outer shell.
Figure 10:
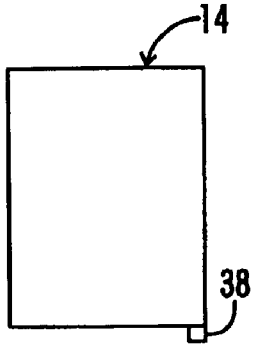
FIG. 10 is a right side view of the outer shell.
Figure 11:
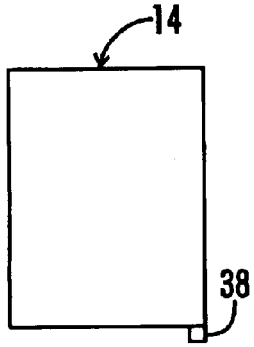
FIG. 11 is a back side view of the outer shell.

The spring 16 is inserted into the pin hollow 44 and the upper end 36 of the spring 16 is inserted into the shell spring hole 42 (shown in FIG. 8). The limiting finger 38 of the outer shell 14 is inserted into the movement control slot 30 on the base 20. In this manner the spring 16 biases the outer shell 14 in relation to the base 20 to a normal position where the ball 18 contacts the conical portion 48 of the internal pin 12. The outer shell 14 can then be rotated in relation to the base 20 to a rotated position where the ball contacts the flat portion 46 of the internal pin 12. The extent of the rotation is controlled by the limiting finger 38 and movement limiting slot 30 connection.

Figure 3C:
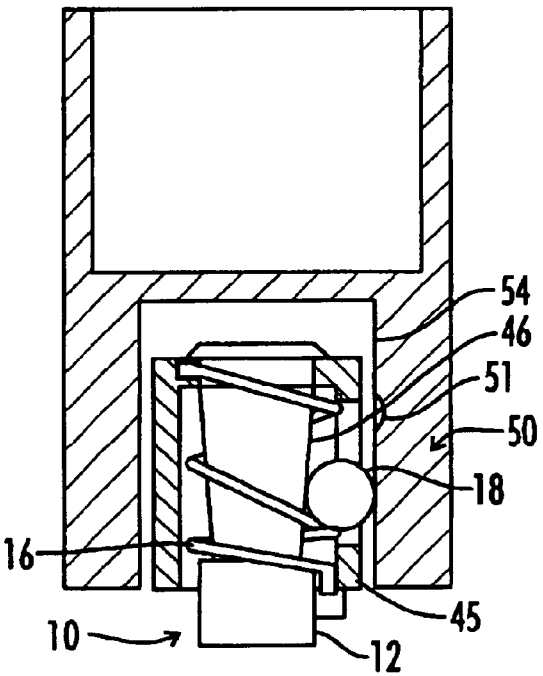
FIGS. 3A, 3B, and 3C show a cutaway view of the action of pressing a socket onto the socket holder head.
Figure 3B:
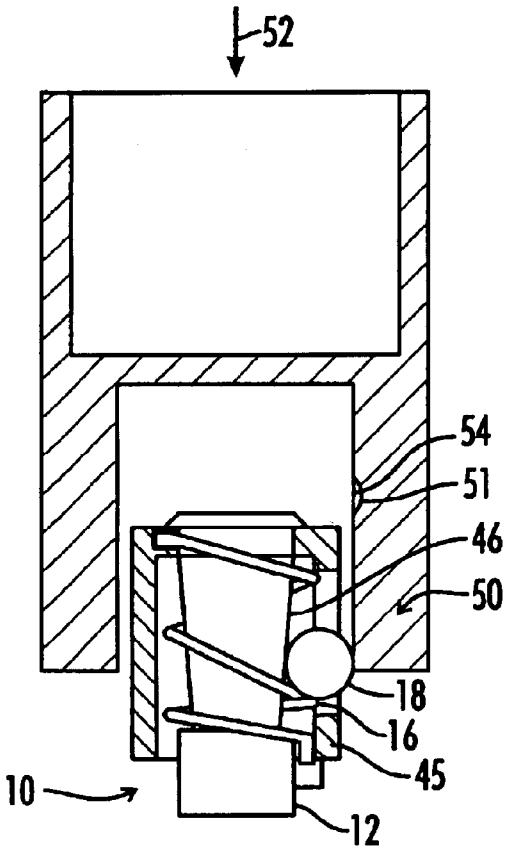
Figure 3A:
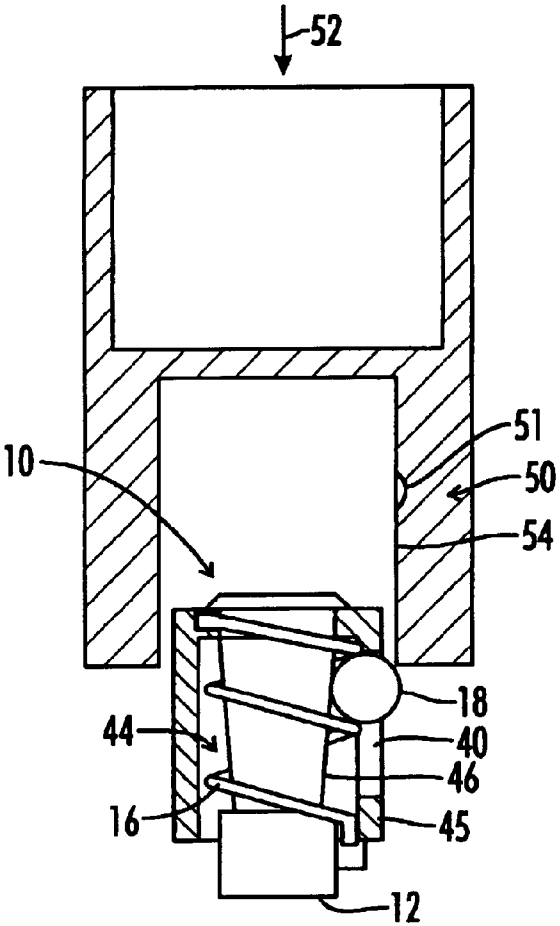

The installation of a socket 50 onto the holder is shown in FIGS. 3A, 3B, and 3C. The internal pin 12 should be fixed in position on the base such that the conical portion 48 of the internal pin 12 presses against the ball 18 when the outer shell 14 is in its normal position. The normal position is also known as the holding position and will be discussed further herein.

The sequence of FIGS. 3A, 3B, and 3C show the installation of a socket 50 onto the holder 10 by using a pressing force 52 pushing the socket 50 onto the holder 10. The ball 18 is designed to move along the sloping angle of the conical section 48 such that the ball 18 can controllably extend outward from the outer shell 14. The conical section 48 is smaller in diameter towards the base and larger in diameter towards the top of the pin 12. As the ball 18 moves upward to the larger diameter section along the conical shape 48 of the internal pin 12, the distance that the ball 18 extends from the wall 45 of the outer shell 14 is increased. As the ball 18 is moved downward towards the small diameter section along the conical portion 48 of the internal pin 12, the ball 18 is recessed further into the outer shell 14 to decrease the amount of extension of the ball 18 from the outer shell 14.

As can be seen in FIGS. 3A, 3B, and 3C, the spring 16 biases the ball 18 in the upward direction to press against the top of the ball opening 40. As a socket 50 is inserted onto the holder 10, the socket 50 presses down on the ball 18 to compress the spring 16 until the ball 18 is sufficiently recessed to allow the socket 50 to be fully inserted onto the holder 10. The ball 18 is then wedged by the spring 16 between the conical section 48 of the internal pin 12 and the internal wall 54 of the socket 50. If an upward force is now applied to the socket 50 in an attempt to remove the socket 50 from the holder 10, then the ball 18 will be further wedged between the pin 12 and the socket wall 54 such that an additional wedging force is created between the internal pin 12 and the socket wall 54. In this manner, the socket 50 is secured onto the holder 10 with a design that increases holding power as the removal force is increased. This allows for the holder 10 to maintain the position of the socket 50 on the holder 10 with an improved retention ability over prior art designs. The ball may also extend into an internal depression 51 on the socket 50 for additional holding power.

Figure 4A:
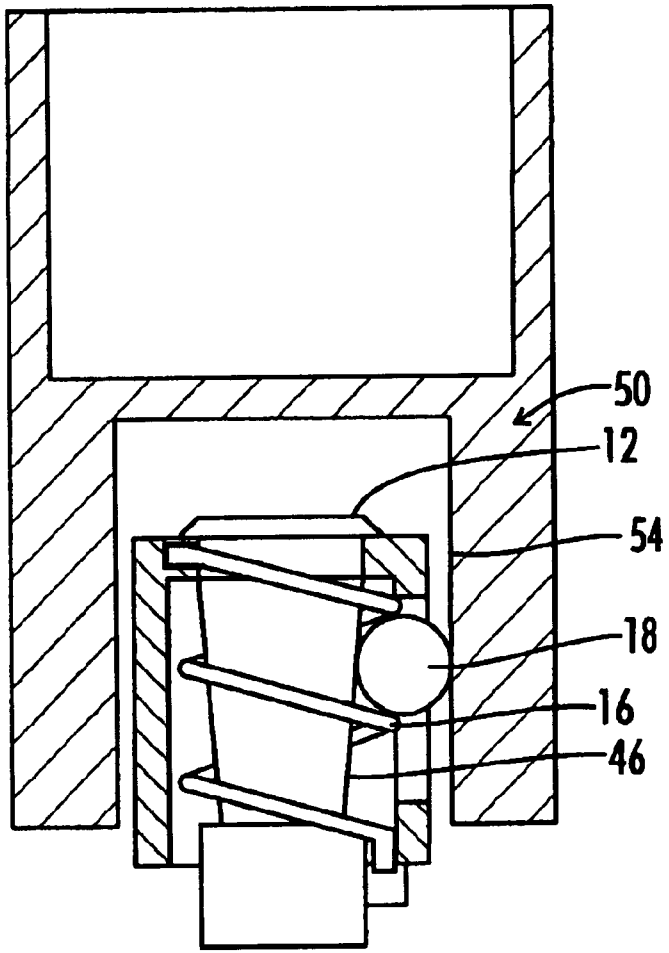
FIGS. 4A and 4B show a cutaway view of the action of the recessing of the ball on the flat portion of the internal pin and extending the ball on the conical portion of the pin.
Figure 4B:
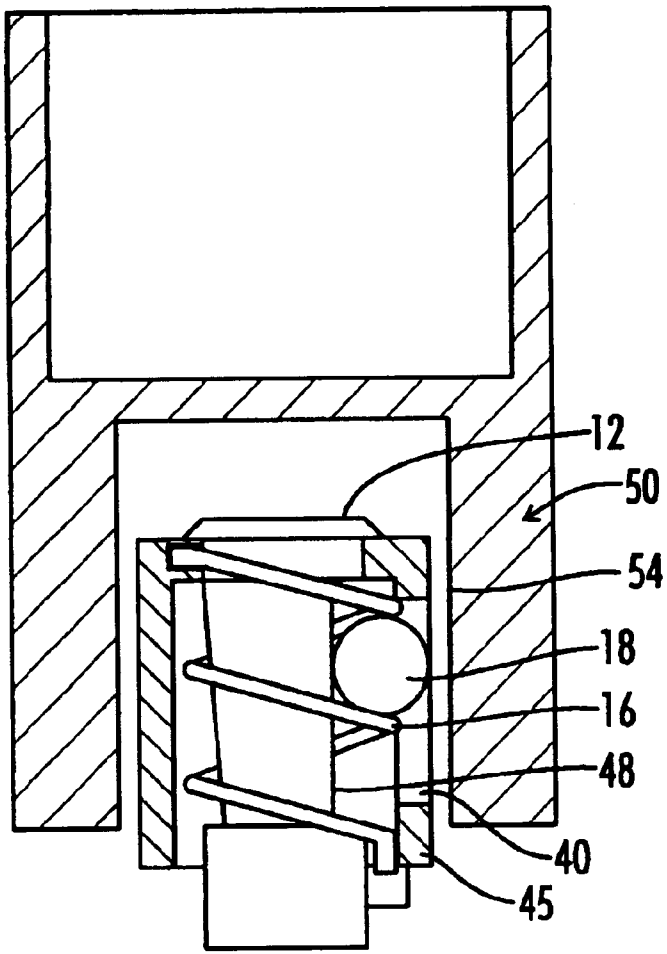
Figure 5C:
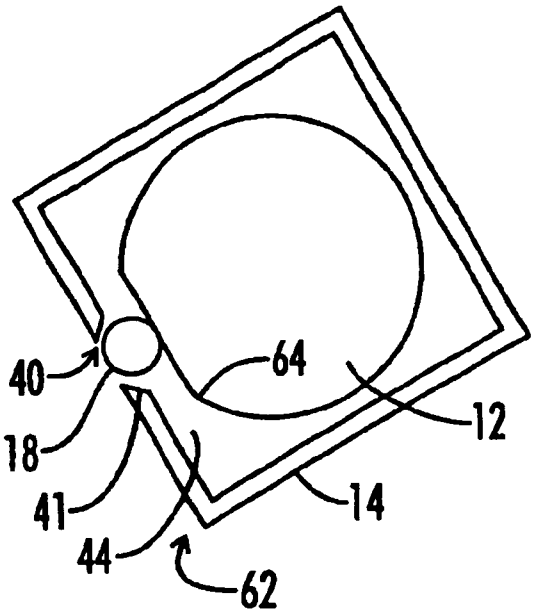
FIGS. 5A, 5B, and 5C show a cutaway view of the retraction of the ball following the shape of the internal pin when the outer shell is rotated.
Figure 5B:
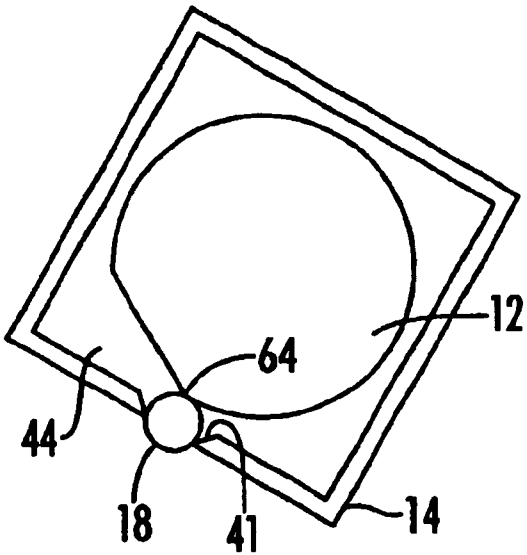
Figure 5A:
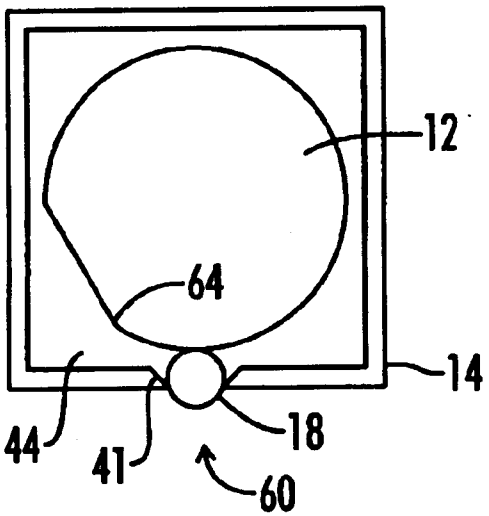
Figure 7:
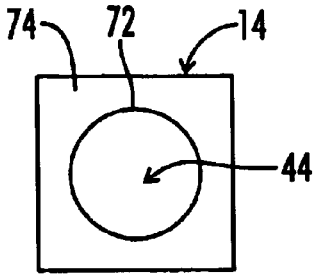
FIG. 7 is a top view of the outer shell.

FIGS. 4A and 4B of the drawings show the removal of the socket 50 from the holder 10 using the flat portion 46 of the internal pin 12. The flat portion 46 does not actually have be flat, but can be made with a reduced curvature to reduce the diameter of the pin 12 to the proper clearance. However, the preferred embodiment uses the flat portion 46 discussed herein. We viewed in a cross sectional view, the conical section 48 has an increased curvature when compared against the flat section 46. Additional reference may be had to FIG. 5A which shows the outer shell 14 in the normal or holding position 60 in relation to the internal pin 12 such that the ball 18 is against the conical portion 48 of the internal pin 12, FIG. 5B which shows a partial rotation of the outer shell 14 in relation to the internal pin 12, and FIG. 5C which shows the rotated position 62 of the outer shell 14 with the ball 18 positioned against the flat portion 46 of the internal pin 12. Thus, the ball 18 will be against the conical section 48 of the internal pin 12 when the socket holder 10 is in the normal holding position 60 and the ball 18 will be against the flat portion 46 of the pin when the socket holder 10 is in its rotated removal position 62. This controls the ability of the ball 18 to be recessed into the pin hollow 44 for easy removal of the socket 50. Note that the prior art teaches a sharp edge on the transition between a flat and arcuate section of a cam element. This invention provides a further improvement to that design by using a radius 64 between the flat portion 46 and the conical section 48 of the preferred design of the socket holder 10 to improve the smoothness of the action of the holder 10 between the holding position 60 and the removal position 62.

FIGS. 6 through 12 show the various views of the outer shell 14 of the socket holder 10. The outer shell 14 is an elongated cube with an internal pin hollow 44 formed by drilling a bore from the bottom 70 of the elongated cube. A smaller top opening 72 is then formed by boring through the top 74 of the outer shell 14. This construction provides for a pin hollow 44 while still allowing a top 74 that may be contacted by a shoulder 80 on the internal pin 12 to retain the outer shell 14.

The outer shell 14 also includes a shell spring hole 42 for connection of the upper end 36 of the spring 16. The upper end 36 of the spring 16 is inserted into this shell spring hole 42 to bias the outer shell 14 in relation to the base 20. The outer shell 14 also defines a limiting finger 38 on the external portion of the shell 14. The limiting finger 38 of the outer shell 14 is inserted into the movement control slot 30 on the base 20. This limits the rotational movement of the outer shell 14 in relation to the base 20 so that excessive rotation is not applied to the spring 16 and also provides a positive stop for the rotational movement to define both the rotated position 62 and the normal position 60.

Figure 6:
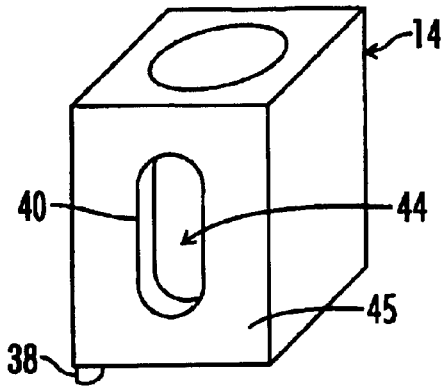
FIG. 6 is an isometric view of the outer shell.
Figure 12:
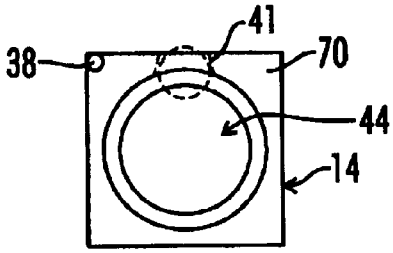
FIG. 12 is a bottom view of the outer shell.
Figure 13:
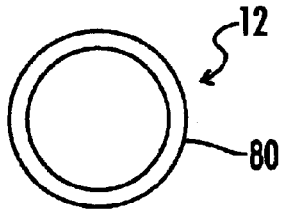
FIG. 13 is a top view of the internal pin.
Figure 14:
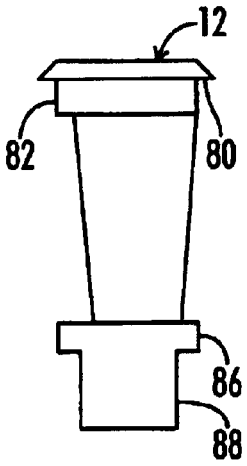
FIG. 14 is a left side view of the internal pin.
Figure 15:
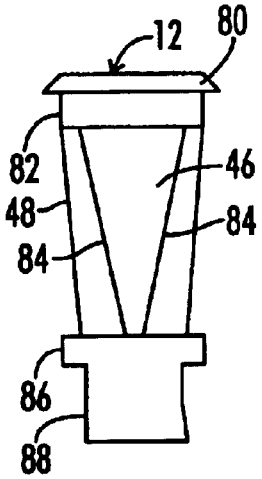
FIG. 15 is a front view of the internal pin.
Figure 16:
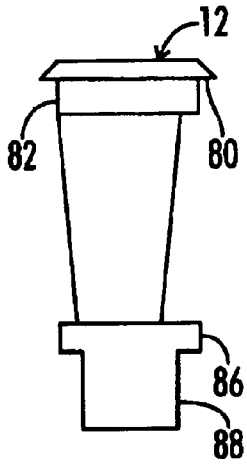
FIG. 16 is a right side view of the internal pin.
Figure 17:
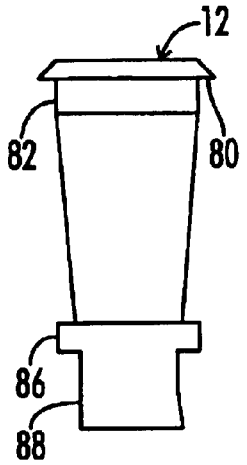
FIG. 17 is a back side view of the internal pin.
Figure 18:
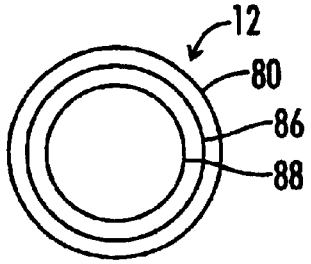
FIG. 18 is a bottom view of the internal pin.
Figure 19:
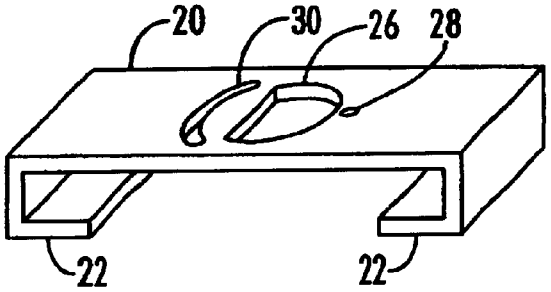
FIG. 19 is an isometric view of the outer shell.
Figure 20:
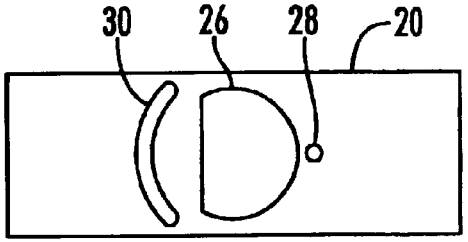
FIG. 20 is a top view of the rack base.
Figure 24:
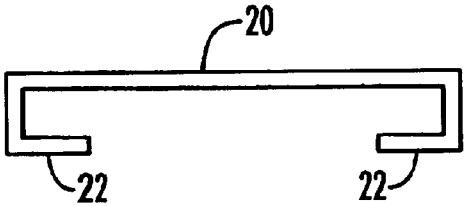
FIG. 24 is a back side view of the rack base.
Figure 23:
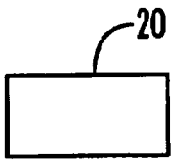
FIG. 23 is a right side view of the rack base.
Figure 22:
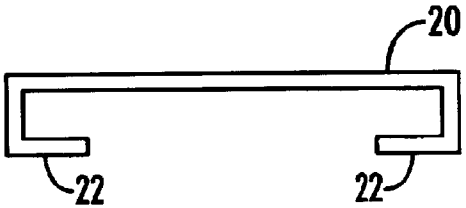
FIG. 22 is a front view of the rack base.
Figure 21:
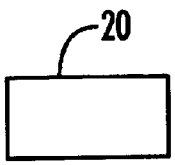
FIG. 21 is a left side view of the rack base.
Figure 25:
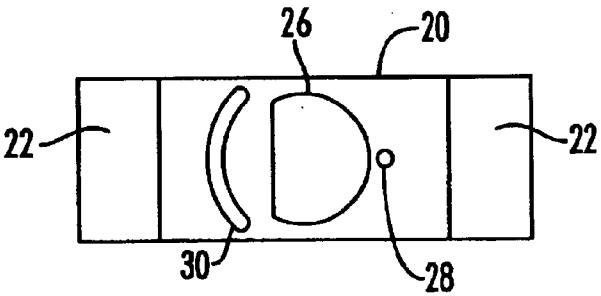
FIG. 25 is a bottom view of the rack base.

As may be seen in FIG. 6 and as shown by the dashed outline of the ball opening 40 and ball 18 shown in FIG. 12, the ball opening 40 is provided with angled sides 41 such that the ball 18 may extend outward from the front wall 45 of the outer shell 14 while still maintaining an appropriate thickness for the remaining walls 45 of the outer shell 14. This may also be partially achieved by reducing the distance between the bore of the pin hollow 44 and the edge of the outer shell 14 by either moving the bore of the pin hollow 44 off of center or increasing the size of the bore to reduce the wall 45 thickness. For the preferred embodiment, the relieved angled edges 41 of the ball opening 40 are used to maintain an appropriate wall 45 thickness.

FIGS. 13 through 18 show the different views of the internal pin 12. The internal pin 12 includes a top shoulder 80 and an upper bearing 82 adapted to mate with the top opening 72 of the outer shell 14. The top shoulder 80 retains the outer shell 14 on the internal pin 12 and the upper bearing surface 82 allows the outer shell 14 to rotate around the internal pin 12. The conical portion 48 angles in from the bearing surface 82 at approximately a two degree angle to form an upside down cone. The flat portion 46 is also formed at a two degree angle to provide the relief clearance necessary to allow for the ball 18 to recess. The edge 84 between the flat portion 46 and the conical portion 48 is radiused to provide for a smoother action as the ball 18 travels around the surface of the internal pin 12. A lower shoulder 86 is provided for a fixed insertion depth of the internal pin 12 into the rail base 20. This allows a controlled amount of clearance for the outer shell 14 to rotate around the internal pin 12 once the pin 12 is fixed to the base 20. Finally, the internal pin 12 includes a base extension 88 designed to fit into the rail base 20 where it may be welded or otherwise fixed to the rail base 20.

FIGS. 19 through 25 show the various views of the rail base 20. The rail base 20 defines the base pin hole 26, base spring hole 28, and movement control slot 30. The base pin hole 26 allows the internal pin 12 to be inserted and fixed in position on the rail base 20. It is envisioned that the base pin hole 26 can be constructed with a pattern to control the alignment of the internal pin 12 the rail base 20 to properly align the internal pin 12 onto the rail base 20. The insertion of the outer shell 14 with the limiting finger 38 inserted into the movement control slot 30 will then properly align the outer shell 14 with the internal pin 12. The base spring hole 26 is used to hold the lower end 34 of the spring 16 in position in relation to the rail base 20.

The spring 16 functions in two ways to provide biasing for the socket holder 10. The connection of the spring 16 between the base spring hole 26 on the rail base 20 and the shell spring hole 42 on the outer shell 14 acts to bias the rotational movement of the outer shell 14 on the rail base 20 to the normal position 60. The spring 16 biases the rotation of the outer shell 14 back to the normal position 60 when the outer shell 14 is rotated on the internal pin 12. The extent of this movement is controlled by the limiting finger 38 in the movement control slot 30 on the rail base 20.

The spring 16 also acts to bias the ball 18 upward in the ball 18 slot to press the ball 18 against the socket 50 when it is installed to ensure proper positioning of the ball 18 for the wedge action of the socket holder 10.

The ball 18 is a simple spherical steel bearing of appropriate size for coordinated movement in the ball 18 slot with the cylindrical portion 48 and flat portion 46 of the internal pin 12.

Thus, although there have been described particular embodiments of the present invention of a new and useful socket holder with wedge retention and rotational release, it is not intended that such references be construed as limitations upon the scope of this invention except as set forth in the following claims.

What is claimed is:

1. A socket holder apparatus for removably holding a socket with a socket base, the socket holder apparatus comprising:

a base;

a pin extending form the base, the pin connected to the base at a proximal end and having both an increased curvature section and a reduced curvature section;

a ball positioned against the pin;

a shell rotatably mounted on the pin and adapted to rotate between a holding position and a release position, the shell defining a ball slot adapted to allow the ball to controllably rotate in relation to the pin between the reduced curvature section when the shell is in the release position and the increased curvature section when the shell is in the holding position; wherein the pin, ball, and shell are adapted to extend into the socket base such that the ball contacts the socket base to hold the socket on the apparatus; and a spring connected between the shell and the pin and adapted to bias the rotation of the shell to the holding position.

2. The apparatus of claim 1, the spring including a coil spring with coils adapted to vertically position the ball within the ball slot.

3. A socket holder apparatus for holding a socket with a socket base, the socket holder apparatus comprising:

a base;

a pin extending from the base, the pin connected to the base at a proximal end and having a conical section with an increasing diameter at the distal end of the pin, the conical section having a reduced curvature side and an increased curvature side;

a ball positioned against the conical section of the pin and adapted to move along the conical section from the proximal end to the distal end;

a shell rotatably mounted on the pin and defining a ball slot adapted to allow the ball to controllably extend from the shell during movement along the conical section of the pin; wherein the pin, ball, and shell are adapted to extend into the socket base such that the ball wedges between the pin and the socket base to hold the socket on the apparatus, the shell adapted to rotate between a holding position and a release position, the ball slot further adapted to allow the ball to controllably rotate in relation to the pin between the reduced curvature section when the shell is in the release position and the increased curvature side when the shell is in the holding position; and a spring connected between the shell and the pin and adapted to bias the rotation of the shell to the holding position.

4. The apparatus of claim 3, wherein the spring positioned between the base and the ball to bias the ball towards the distal end of the pin.

5. The apparatus of claim 3, wherein the spring is connected to the shell and the pin in contact with the ball to bias the ball toward the distal end of the pin while returning the shell to the holding position.

* * * * *